US006570303B2

(12) United States Patent
Okazaki

(10) Patent No.: US 6,570,303 B2
(45) Date of Patent: May 27, 2003

(54) LIGHT UNIT WITH IMPROVED HEAT DISSIPATION

(75) Inventor: Yoshio Okazaki, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 71 days.

(21) Appl. No.: 09/804,310

(22) Filed: Mar. 13, 2001

(65) Prior Publication Data

US 2001/0040806 A1 Nov. 15, 2001

(30) Foreign Application Priority Data

Mar. 17, 2000 (JP) ..... 2000-075435

(51) Int. Cl.[7] ..... H01J 61/00
(52) U.S. Cl. ..... 313/113; 313/571; 313/573
(58) Field of Search ..... 313/113, 570, 313/571, 573, 634; 362/296, 310, 341

(56) References Cited

U.S. PATENT DOCUMENTS 5,109,181 A 4/1992 Fischer et al.
5,497,049 A 3/1996 Fischer
5,574,328 A * 11/1996 Okuchi ..... 313/113
6,002,197 A * 12/1999 Tanaka et al. ..... 313/113
6,402,348 B1 * 6/2002 Ouellette et al. ..... 362/296

FOREIGN PATENT DOCUMENTS

JP 1-113506 5/1989
JP 9-161725 6/1997

* cited by examiner

*Primary Examiner*—Ashok Patel
(74) *Attorney, Agent, or Firm*—Nixon Peabody LLP; David S. Safran

(57) ABSTRACT

A lamp unit (3) for use with digital micromirror devices has a direct current short arc discharge lamp (1) in which at least 0.15 mg/mm$^3$ of mercury is sealed. A short focal length, elliptical reflector mirror (2) both covers the discharge lamp (1) and positions the axis of radiation roughly in line with the long axis of the discharge lamp, such that the short arc discharge lamp (1) is placed with the cathode (14) in a front opening of the reflector mirror (2)

2 Claims, 2 Drawing Sheets

LIGHT UNIT WITH IMPROVED HEAT DISSIPATION

BACKGROUND OF THE INVENTION

1. Field of the Invention

This invention concerns a lamp unit used as a light source for projection equipment that uses a digital micro-mirror device.

2. Description of Related Art

Projection equipment is required to project an image on a screen, evenly and with full color characteristics. To achieve this, metal halide lamps, in which a mercury and a metal halide are sealed, are commonly used as light sources. In recent times these metal halide lamps have come to have very small inter-electrode gaps, making them smaller and more nearly point light sources.

Lamps with unprecedentedly high mercury vapor pressure, 200 bar (about 197 atmospheres), have recently been proposed to replace metal halide lamps. Making the mercury vapor pressure higher is intended to suppress the spread of the arc and make the light output even higher. Examples include JPO Kokai Patents H2-148561 (U.S. Pat. No. 5,109,181) and H6-52830 (U.S. Pat. No. 5,497,049).

In liquid crystal projection equipment, the light radiated from the light source is divided into three colors (R, G, B). Each ray is then adjusted by the liquid crystal, and the three colors are combined and projected onto the screen.

In liquid crystal projection equipment of this sort, the previously mentioned super high pressure lamp, surrounded by a reflector mirror, is used as the light source. The reflector mirror that illuminates the liquid crystal panel can be parabolic or elliptical, but is generally a prolate ellipsoid with a short focal distance.

Recently, however, projection equipment that uses DMD (Digital Micromirror Devices) instead of liquid crystal has been proposed. In particular, DMD substrates have been realized in the small projector industry. In these small projectors, the light radiated from the light source passes through a three-color (R, G, B) filter and illuminates the DMD, and the light reflected from the DMD shines on the screen. The DMD is packed with millions of small mirrors, one per pixel, and the direction in which light is reflected can be changed by controlling the orientation of each mirror independently.

This DMD substrate projection (DLP) equipment, because it does not require the RGB three-color liquid crystal panel, can be made smaller than the liquid crystal projection equipment (down to about B5 size); and in that sense is quite remarkable.

SUMMARY OF THE INVENTION

The projection equipment using DMD has a great advantage in that the equipment as a whole is quite small. Thus, it is also necessary to make the distance between the lamp and the rotating filter as small as possible. Moreover, in order to confine the light reflected from the lamp toward the DMD, an elliptical, beam-condensing mirror is used instead of a parabolic mirror. That is, because of the size constraints, the reflected light from the lamp has to be concentrated in a short distance and a short focal length, elliptical, beam-condensing mirror is adopted as the reflector mirror.

Moreover, in the event that an alternating current discharge lamp is used as the light source, the changes in the lamp polarity have to be synchronized with the movement of the rotating filter and the DMD, and thus fluctuation of the reflected light with each change of polarity need be prevented. For these reasons, it is advantageous to use a direct current discharge lamp rather than an alternating current discharge lamp, as the light source for DMD projection equipment.

In this way, the necessary conditions for the light source of projection equipment using DMD include the use of a short focal-length, elliptical, beam-condensing mirror as the reflector mirror, and a direct current, very high pressure, short-arc mercury lamp as the discharge lamp.

However, there is the problem that the light radiated from the lamp that cannot be accommodated by the rotating filter is reflected by the filter and illuminates the seals of the lamp, and causes the seals to heat up. Since an elliptical reflector mirror is used, as stated above, the arcing point of the discharge lamp is located at the first focal point of the ellipse, and the second focal point is the beam-condensing point of the rotating filter. Because DMD projection equipment uses this sort of short focal length and an elliptical, beam-condensing mirror, the distance between the rotating filter and the seal is short; overheating is a problem. Thus, when the temperature of the lamp seal rises, a major problem such as the breakage, oxidation or melting of the metallic foil within the seal can occur.

Secondly, a direct current discharge lamp produces different amounts of heat at the anode and the cathode, and generally the volume of the anode is larger than that of the cathode, in connection with heat capacities. If miniaturization of the lamp causes the anode to be larger, cool regions are liable to form near the base of the larger anode. The arc lamps used in projection equipment frequently include more than 0.15 mg/mm$^3$ of mercury, and have a characteristic problem of non-vaporized mercury accumulating in these cool regions. This non-vaporized mercury is a problem, since it obstructs the generation of the light spectrum that is desired.

The problem to be resolved by this invention is the provision of a lamp unit suitable for projection DMD equipment.

These and other features and advantages of this invention are described in or are apparent from the following detailed description of the embodiments.

The embodiments of the invention described below in detail, with reference to the accompanying figures.

DETAILED DESCRIPTION OF THE INVENTION

Figure 1:
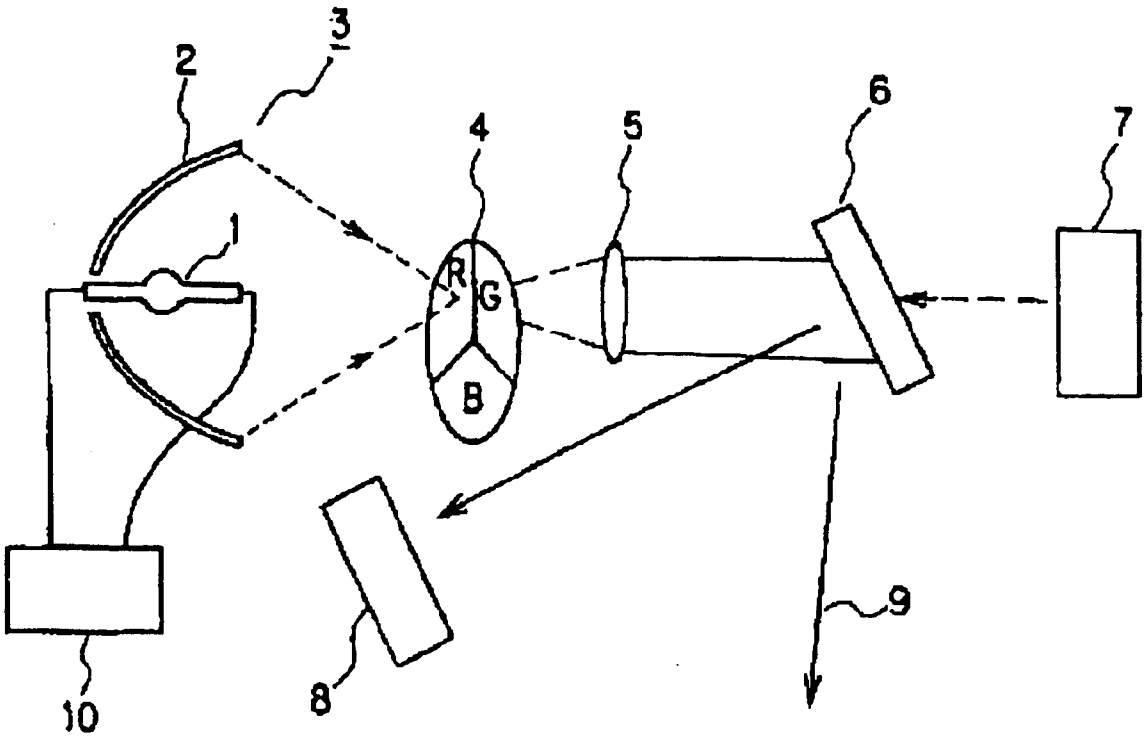
FIG. 1 is a block diagram of projector using the DMD according to one embodiment of this invention.

FIG. 1 is a block diagram of the DMD projection equipment. A discharge lamp 1 and a reflector mirror 2 make up the lamp unit, and lighting of the discharge lamp is controlled by a power supply 10. The light radiated directly from the discharge lamp 1 and the reflected light from the reflector mirror 2 are condensed and enter a rotating filter 4. The light that has passed through this filter 4 passes through a condenser lens 5 and arrives at a DMD 6 (digital micromirror device). The DMD 6 receives signals from a controller 7, in response to which the millions of mirrors are individually controlled and discriminate between the rays reflected toward projector lens 8 and the other rays 9.

Figure 2:
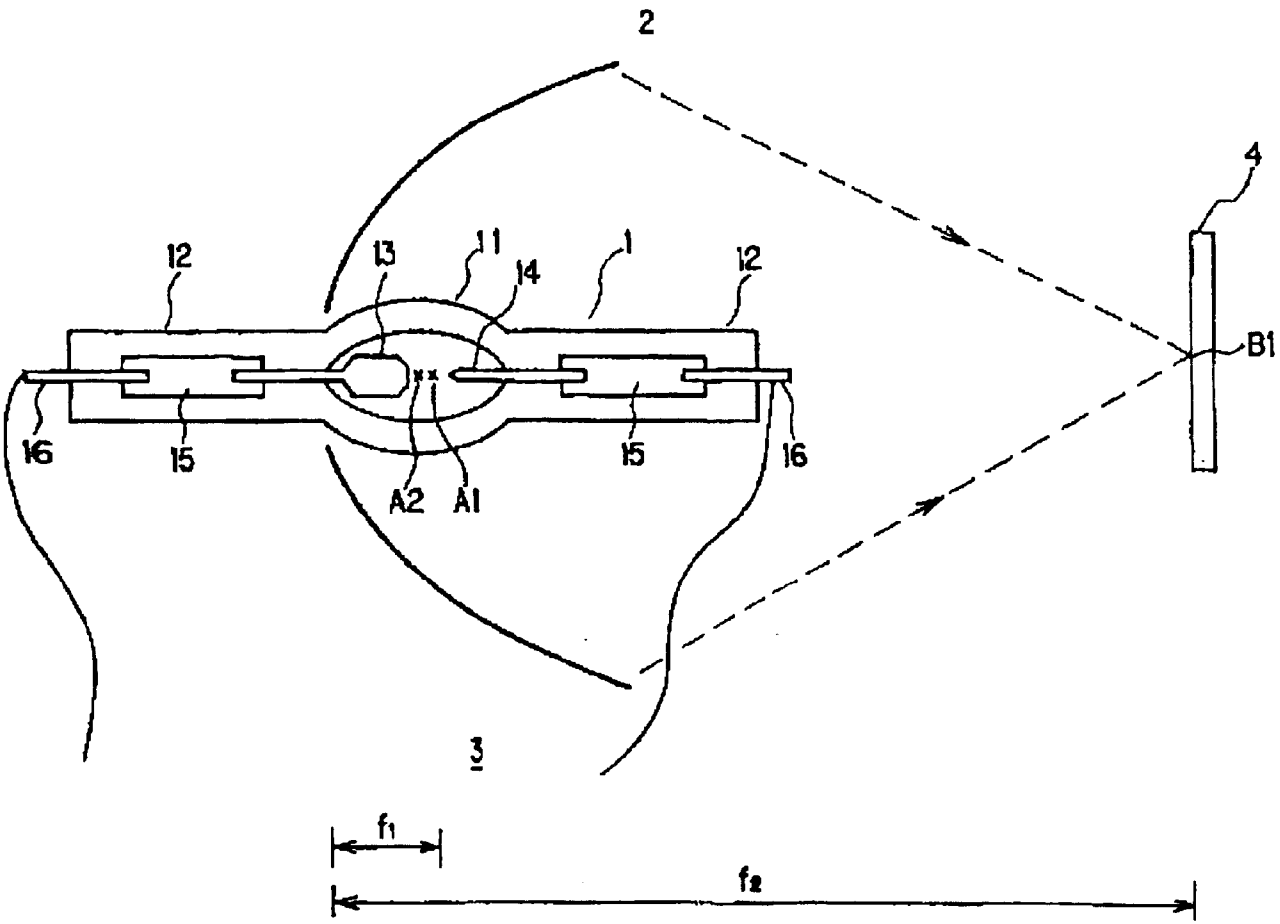
FIG. 2 illustrates an exemplary lamp unit according to one embodiment of this invention.

FIG. 2 shows the lamp unit 3, which comprises the discharge lamp 1 and the reflector mirror 2. The discharge lamp 1 is made of, for example, quartz glass, and has a lighting portion 11 at its center and seal portions 12 at both ends. Within the lighting portion 11 there is a luminescent space which is a gap of about 1.0 to 2.0 mm between the tungsten anode 13 and the facing tungsten cathode 14. The anode 13 and the cathode 14 are connected to metallic foil 15 of molybdenum within the seal portions 12, and external leads 16 extend from the metallic foil 15. Although it is not shown in the drawing, the external leads 16 are connected electrically to the power supply 10.

Mercury is sealed into the luminescent space as a luminescent substance, and a rare gas such as argon or xenon is sealed in as a starter gas. For example, $1.3\times10^4$ Pa argon can be included as the rare gas. Additionally, for example, 0.16 $mg/mm^3$ of mercury is also sealed in the luminescent space. The amount of mercury should be at least 0.15 $mg/mm^3$. This increases the pressure of the mercury, and enables radiation in the visible light spectrum, e.g., a wavelength about 300 to 550 nm. In this way it is possible to provide a projector light source with superior color characteristics.

It is also possible to include compounds of halogens, such as iodine or bromine, to the materials sealed in the luminescent space.

The reflector mirror 2 is an elliptical beam-condensing mirror with a short focal length, and the distance f1 from the apex of the reflector mirror to the arc point (between anode 13 and cathode 14) is 4 to 12 mm. The distance from the apex of the reflecting mirror to the beam-condensing point of the discharge lamp, which is distance f2 to the rotating color filter, is 40 to 120 mm. The reflector mirror 2 is made with a base of, for example, borosilicate glass coated inside by a multilayer vapor deposition of, for example, titanium and silica. The front opening of the reflector mirror 2 is, for example, 40 mm in diameter.

One characteristic of this invention is that the cathode of the discharge lamp is positioned toward the front opening of the concave reflector mirror, and the anode is positioned toward the apex of the concave reflector mirror. Because the arc point A1 of the discharge lamp is located at the first focal point of the reflector mirror, the light radiated from the arc point A1 easily travels to the beam-condensing point on the rotating filter 4, which is the second focal point. However, the light radiated from arc point A2 does not arrive at the second focal point, so that light is reflected by the rotating filter 4. That is, part of the light radiated by the discharge lamp is reflected by the rotating color filter 4 back to the discharge lamp. That is because the arc point is not a perfect point; in reality there is an arc width that forms between the electrodes. Thus the reflected light heats up the seal 12.

The electrodes within the lighting portion are heated by the arc and gas convection, but that heat is conducted by the metallic foil within the seal toward the external lead, where it is exhausted. Because the heat emitting volume of the anode is greater than that of the cathode, as stated above, when the generated heat is conducted away, the temperature of the anode seal is naturally higher than that of the cathode seal. In this invention, therefore, the cathode seal that releases less heat is the seal that receives the light reflected by the color filter, and so an unusual temperature rise in the seal is avoided.

Moreover, in the projector light source discharge lamp according to an embodiment of this invention, the volume of the anode is large relative to the small luminescent space, and the anode occupies a large part of the length of the electrode axis of the lighting portion. For this reason, a cool region develops near the base of the anode. Thus, mercury accumulates in the cool region and does not vaporize, which results in the difficulty that the light spectrum emitted is not suitable for projection.

However, the outer surface of the lighting portion near the base of the electrodes is subjected to heat radiated from the reflector mirror. The lamp unit according to this invention, in particular, is made small, and the outer surface of the lighting portion is close to the reflector mirror. Thus, the anode is located with its base toward the reflector mirror, and the base of the anode can be warmed by the heat radiated from the reflector mirror; thus it is possible to solve the problem of the non-vaporization of mercury.

The projection lamp unit of this invention is positioned, as explained above, with the cathode of the discharge lamp toward the front opening of the reflector mirror. Consequently, it is possible to reduce to a minimum the problem of reflected light from the rotating color filter, which is located just in front of the lamp unit. Since the anode of the discharge lamp is positioned at the apex of the reflector mirror, it is possible to prevent the occurrence of cold regions, by using the heat that is radiated from the reflector mirror.

It is, therefore, apparent that there has been provided, in accordance with the present invention a light unit system. While this invention has been described in conjunction with a number of embodiments, it is evident that many alternatives, modifications and variations would be or are apparent to those of ordinary skill in the applicable arts. Accordingly, it is the intent to embrace all such alternatives, modifications, equivalents and variations that are within the spirit and scope of this invention.

What is claimed is:

1. A lamp unit for use with digital micromirror devices comprising:

a direct current short arc discharge lamp having an anode and a cathode and in which mercury is sealed; and a short focal length, elliptical reflector mirror having a front opening and that both covers the discharge lamp and positions an axis of radiation roughly in line with a long axis of the discharge lamp;

wherein the distance from the apex of the reflector mirror to the arc point between the anode and the cathode is 4 to 12 mm; and wherein the distance from the apex of the reflecting mirror to the beam-condensing point of the discharge lamp is 40 to 120 mm.

2. The lamp of claim 1, wherein the mercury is sealed in the direct current short arc discharge lamp is in an amount equal to at least 0.15 $mg/mm^3$.

* * * * *